US011718058B2

(12) United States Patent
van der Dong et al.

(10) Patent No.: US 11,718,058 B2
(45) Date of Patent: Aug. 8, 2023

(54) FOLDING UNIT FOR FOLDING CARDBOARD BLANKS, FOLDING APPARATUS COMPRISING SUCH FOLDING UNIT AND METHOD FOR FOLDING CARDBOARD BLANKS

(71) Applicant: Sparck Technologies B.V., Drachten (NL)

(72) Inventors: Harm van der Dong, Drachten (NL); Erik Huizinga, Drachten (NL)

(73) Assignee: Sparck Technologies B.V., Drachten (NL)

( * ) Notice: Subject to any disclaimer, the term of this patent is extended or adjusted under 35 U.S.C. 154(b) by 731 days.

(21) Appl. No.: 15/341,907

(22) Filed: Nov. 2, 2016

(65) Prior Publication Data

US 2017/0190134 A1 Jul. 6, 2017

(30) Foreign Application Priority Data

Dec. 31, 2015 (DE) ..... 102015123012

(51) Int. Cl.

| | |
|---|---|
| ***B31B 50/26*** | (2017.01) |
| ***B31B 50/52*** | (2017.01) |
| ***B65B 7/20*** | (2006.01) |
| ***B65B 7/26*** | (2006.01) |
| ***B65D 5/18*** | (2006.01) |

(Continued)

(52) U.S. Cl.

CPC ..... *B31B 50/52* (2017.08); *B31B 50/26* (2017.08); *B31B 50/262* (2017.08); *B65B 7/20* (2013.01); *B65B 7/26* (2013.01); *B65D 5/18* (2013.01); *B65D 5/4266* (2013.01); *B65D 5/66* (2013.01); *B31B 50/34* (2017.08); *B31B 2100/0024* (2017.08); *B31B 2100/0026* (2017.08); *B65B 43/265* (2013.01)

(58) Field of Classification Search

CPC ..... B65D 5/18; B65D 5/4266; B65D 5/66; B31B 50/52; B31B 2100/0026; B31B 2100/0024; B31B 50/48; B31B 50/732; B31B 50/262; B31B 50/26; B31B 50/34; B65B 7/26; B65B 7/20; B65B 43/265

USPC ..... 493/405, 79, 69

See application file for complete search history.

(56) References Cited

U.S. PATENT DOCUMENTS 2,170,759 A * 8/1939 Lentine ..... B26F 1/12 493/128

2,957,395 A 10/1960 Meyer (Continued)

FOREIGN PATENT DOCUMENTS

FR 2 554 417 A1 5/1985

OTHER PUBLICATIONS

Extended European Search Report, dated May 15, 2017, for European Application No. 16191531.9-1708, 6 pages.

*Primary Examiner* — Sameh Tawfik

(74) *Attorney, Agent, or Firm* — Cozen O'Connor

(57) ABSTRACT

Folding unit for folding cardboard blanks having an end panel, a corner panel and a side panel, said folding unit comprising an end panel folding element actuable to pivot about a first axis and a side panel folding element actuable to pivot about a second axis, said folding unit comprising a corner panel folding element, said corner panel folding element comprising a guiding plate, said guiding plate being actuable to move about at least one axis in order to initiate folding a corner panel about an axis being substantially parallel to said second axis.

20 Claims, 8 Drawing Sheets

(51) Int. Cl.

| | |
|---|---|
| ***B65D 5/42*** | (2006.01) |
| ***B65D 5/66*** | (2006.01) |
| *B65B 43/26* | (2006.01) |
| *B31B 100/00* | (2017.01) |
| *B31B 50/34* | (2017.01) |

(56) References Cited

U.S. PATENT DOCUMENTS

| | | | | | |
|---|---|---|---|---|---|
| 3,013,477 | A | | 12/1961 | Meyer | |
| 3,513,757 | A | * | 5/1970 | Di Frank | B65H 1/06 493/131 |
| 3,631,769 | A | * | 1/1972 | Hammerle | B65B 43/10 493/424 |
| 5,352,178 | A | * | 10/1994 | Pazdernik | B65B 43/39 493/137 |
| 5,588,281 | A | * | 12/1996 | Boriani | B65B 19/20 53/443 |
| 5,624,368 | A | * | 4/1997 | Cromwell | B65D 5/06 493/152 |
| 5,632,713 | A | * | 5/1997 | Canning | B31B 70/00 493/137 |
| 7,585,265 | B2 | * | 9/2009 | Gebhardt | B31B 50/262 493/70 |
| 8,282,537 | B2 | * | 10/2012 | Gebhardt | B26F 1/12 493/136 |
| 10,155,352 | B2 | * | 12/2018 | Sytema | B31B 50/262 |
| 2013/0090222 | A1 | * | 4/2013 | Green | B31B 50/00 493/162 |
| 2016/0185065 | A1 | * | 6/2016 | Sytema | B65B 5/024 493/180 |

* cited by examiner

PRIOR ART

FOLDING UNIT FOR FOLDING CARDBOARD BLANKS, FOLDING APPARATUS COMPRISING SUCH FOLDING UNIT AND METHOD FOR FOLDING CARDBOARD BLANKS

TECHNICAL FIELD

This disclosure relates to a folding unit for folding cardboard blanks as used in automatic cardboard folding systems, and also relates to a folding apparatus comprising such folding unit and a method for folding cardboard blanks.

BACKGROUND

In recent years, mail ordering has become increasingly common. In order to cope with the increased need for packaging mail ordered items, different systems and methods for automatically forming packaging boxes have been proposed.

While assembling a shipment in a warehouse is nowadays often done more or less fully automated, packaging the items to be shipped is still a challenge, in particular when a shipment comprises several items of different sizes and in different quantities. Often, the items to be packaged are provided automatically to a person packaging the items manually. Depending on the size and number of the items, the person selects a suitable box size. Generally the box is a cardboard box that upon packaging is assembled from a corresponding cardboard blank.

US 2008/0020916 A1 discloses a box-making machine, which executes creasing and cutting steps to obtain a cardboard blank, which is then folded to obtain a packaging box from the blank. The embodiments described in the present application may be advantageously used in this type and similar types of machines.

To automate the packaging process even in cases where the items vary in size and number, a system has been proposed in WO 2014/117817 A1 that allows creating a custom sized box from a roll or a stack of cardboard by cutting out a custom sized blank, from which then a suitable box is folded automatically. The respective folding apparatus comprises folding units. FIG. 2 shows a folding unit according to this prior art document, which comprises an end panel folding element actuable to pivot about a first axis, a side panel folding element actuable to pivot about a second axis, and a so-called "initiator", which is transversally moveable. In use, the end panel folding element folds an end panel of a respective cardboard blank placed on (or beneath, as will be explained later) the folding unit upwards while the initiator pushes the corner panel upwards. Then, the side panel folding element is actuated to fold a respective side panel of the blank upwards. The order of activation of the end panel folding element, the initiator and the side panel folding element shall ensure that the corner panels are on the inner side of a packaging box formed from the blank, while the side panels are on the outside of the corner panels. The order and the timing of the activation of the elements are rather critical to ensure proper folding of the box.

FIG. 3 depicts an intermediate state of forming a packaging box from a cardboard blank, from which the terminology used in the present description with respect to the single panels of the blank can easily be understood. From this picture, it is also clear that the upper part of the box forming a cover for the box needs to be folded after filling the box in a way similar to the way the lower part of the box has been folded. For folding the respective side, corner and end panels of the upper part, folding units similar or identical to the one shown in FIG. 2 can be used, but of course in that case the panels are positioned beneath the folding units as mentioned above. Both, FIG. 2 and FIG. 3 will later be described in more detail. While FIG. 3 depicts a box with an "integrated" cover, it should be understood that the described embodiments refer to box folding in general and can obviously be used for folding so called open boxes, which may be closed by a separate lid, and for folding lids.

While the apparatus described in WO 2014/117817 A1 works perfectly well for many situations, it has turned out that, as the cardboard used for cutting out the blanks is usually fed from a stack of zig-zag folded cardboard, so-called unwanted folds (namely the folds introduced into the cardboard upon zig-zag folding the cardboard for stacking), may be at positions that hamper correct folding of the corner panels. According to the prior art, the initiator simply pushes the corner panel upwards (respectively downwards, if the upper part of the box is folded) hoping that the side panels will come into contact with the corner panels while being folded and will then guide the corner panels to the wanted position.

DISCLOSURE OF EMBODIMENTS OF THE INVENTION

Various embodiments provide an improved folding unit and a corresponding method for folding cardboard blanks, which ensure proper positioning and folding of the corner panels. Various embodiments may also give improved control over a cardboard blank upon folding.

Such may be achieved by a folding unit according to disclosed embodiments, respectively a method according to disclosed embodiments. Embodiments are disclosed which relate to a folding apparatus comprising a folding unit.

The described embodiments advantageously ensure that corner panels are throughout their folding process guided by respective guiding plates, which in turn ensures proper folding and positioning of the corner panels in a much more reliable way than a side panel made of cardboard could do. This and other advantages will become apparent from the following description of preferred embodiments, which are given as non-limiting examples to facilitate understanding the invention.

DESCRIPTION OF PREFERRED EMBODIMENTS

Figure 1:
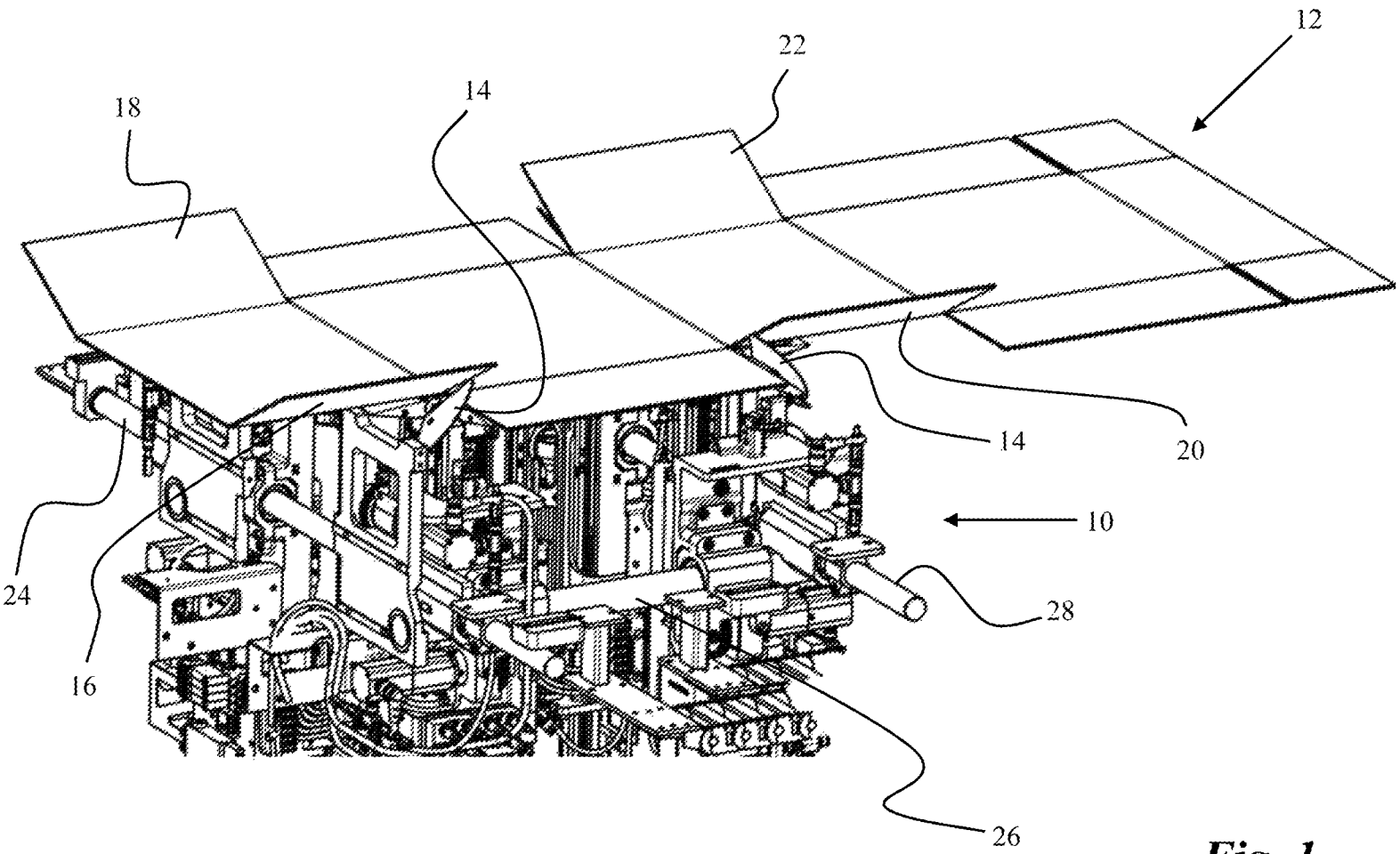
FIG. 1 shows schematically a box folding apparatus in a situation, where it has just started folding the bottom part of a cardboard box from a cardboard blank.

FIG. 1 shows schematically some parts of a folding apparatus 10 for folding cardboard blanks in order to form packaging boxes. The apparatus shown comprises four folding units, each comprising a corner panel folding element 14, of which in the shown situation, in which a cardboard blank 12 has been placed on the folding apparatus and the corner panel folding elements 14 have started to push the corner panels 16, 18, 20 and 22 upwards, only two are visible.

The folding units are slidably mounted on rods 24, 26 and 28 in order to be moveable in a plane parallel to the plane of the cardboard blank 12, as the cardboard blanks to be folded may differ in size and hence the positions of the panels of the cardboard blank to be folded by the folding apparatus may vary from blank to blank.

The folding apparatus 10 usually forms part of an automatic packaging system, in which custom sized boxes can be created from cardboard fed into the system usually from zig-zag folded stacks of cardboard and in which items to be shipped are automatically packaged in the boxes formed. Such system is disclosed for example in WO 2014/117817 A1, the disclosure of which is herewith incorporated by reference.

Figure 2:
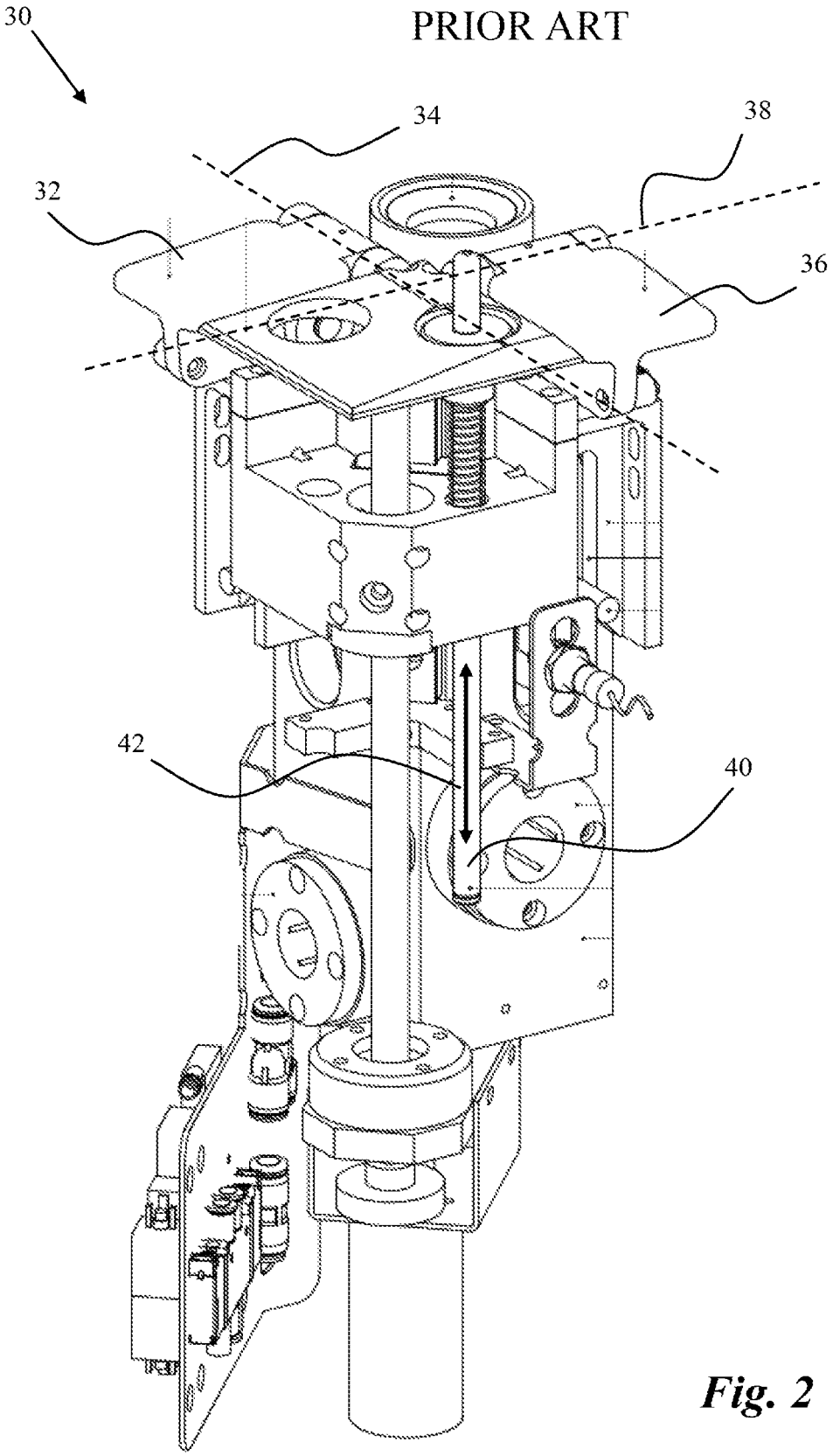
FIG. 2 shows a folding unit according to the prior art.

FIG. 2 shows a folding unit 30 according to the prior art as disclosed in WO 2014/117817 A1. The folding unit 30 comprises an end panel folding element 32, which is actuable to pivot about a first axis indicated by broken line 34, a side panel folding element 36, actuable to pivot about a second axis indicated by broken line 38 and a so-called initiator 40 actuable to move transversally as indicated by arrow 42.

In use, initiator 40 pushes a corner panel of a blank positioned on the folding unit 30 upwards while the end panel folding element 32 pushes the end panel, to which said corner panel is attached (as will become apparent from FIG. 3) upwards. Once these movements have reached a certain position, side panel folding element 36 starts pushing the respective side panel of the blank upwards, so that the side panel comes into contact with the corner panel and guides the corner panel to its intended position, when the end panel folding element 32 and the side panel folding element 36 are further pivoted to erect the respective panels of the cardboard. As described above, a cardboard side panel cannot always ensure proper guiding and folding of the corner panels.

Figure 3:
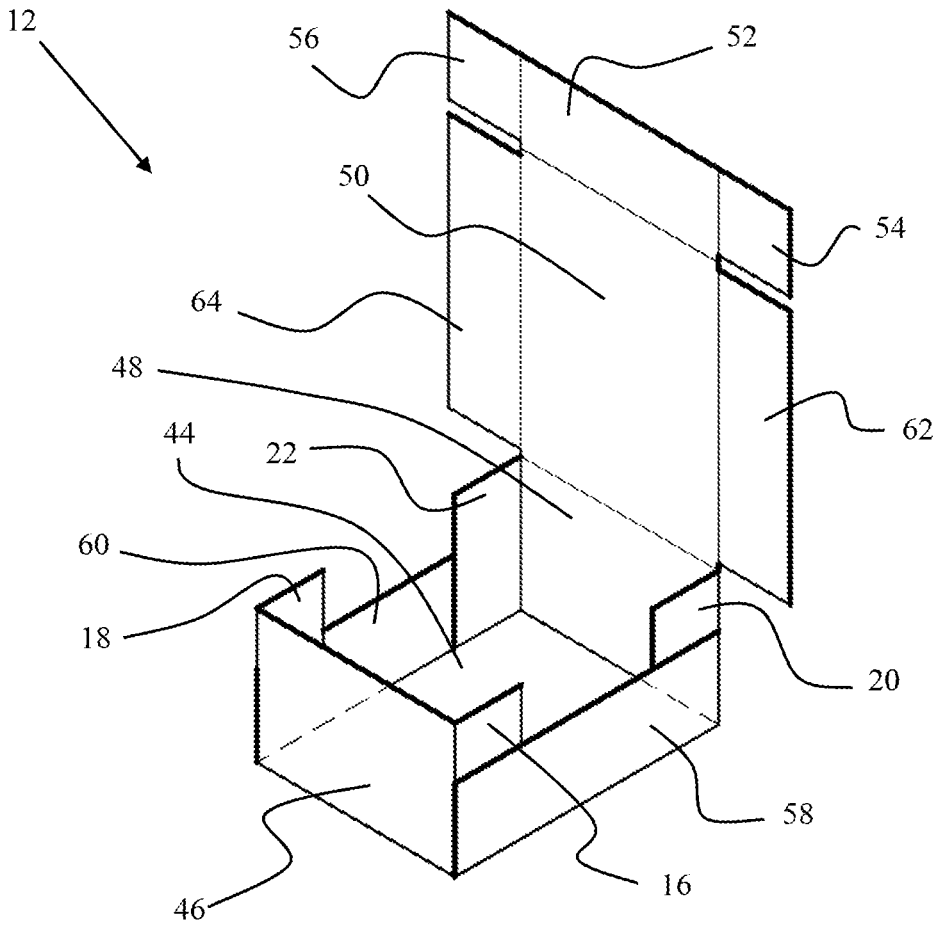
FIG. 3 shows a cardboard blank in a situation, where it has been folded to form the bottom part of a packaging box.

FIG. 3 depicts a cardboard blank 12 in a situation, where it has been folded to form the bottom part of a packaging box. Cardboard blank 12 comprises a bottom panel 44, to which two end panels 46 and 48 are attached, and a top panel 50, to which end panel 52 is attached. By "attached" it is meant that the respective panels are connected with each other. In fact, all panels are integrally formed by creasing and cutting a single cardboard blank. In this sense, corner panels 16 and 18 already mentioned above are "attached" to end panel 46, corner panels 20 and 22 already mentioned above are attached to end panel 48, and corner panels 54 and 56 are attached to end panel 52. Furthermore, side panels 58 and 60 are attached to bottom panel 44, and side panels 62 and 64 are attached to top panel 50. Two panels attached to each other are delimited against each other by crease lines, which form "hinges" about which the respective panels shall be folded to form a box. As mentioned above, various embodiments of the present invention may also be used for folding open boxes or lids, for example a box comprising only one base panel such as bottom panel 44, two side panels, two end panels and four corner panels.

Figure 4:
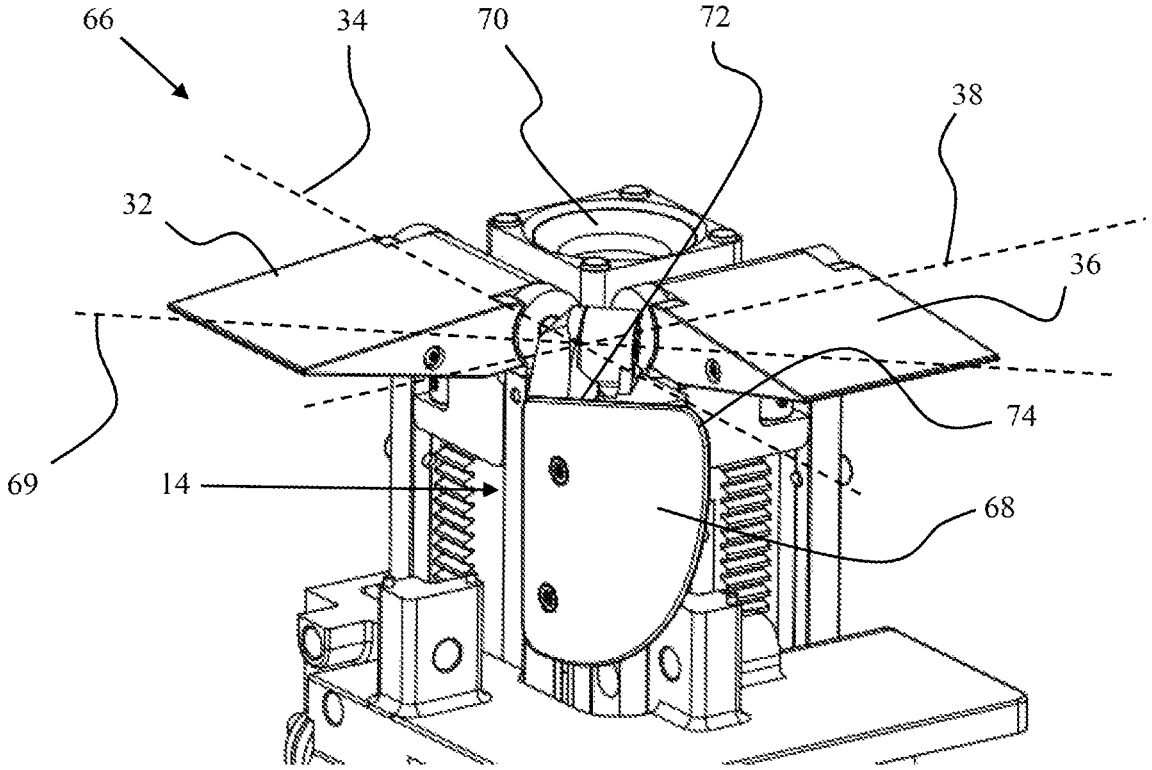
FIG. 4 shows a part of a folding unit according to at least one illustrated embodiment of the invention in a situation, where all elements are in their idle position.

FIG. 4 depicts the upper part of a folding unit 66, the lower part of which basically corresponds to the lower part of a folding unit 30 as shown in FIG. 2 except for the initiator, which in the folding unit 66 is replaced by a corner panel folding element, which in its entirety is denoted by 14. The corner panel folding element 14 comprises a guiding plate 68, which is actuable to move about an axis 69, which may be a virtual axis or an actual axis and which, in the shown embodiment, runs, if seen from above, at an angle of about 0° to 60°, for example 45° with respect to both axes 34 and 38. A movement about such axis 69 can be regarding as comprising a movement about two separate axes, namely an axis substantially parallel or corresponding to the axis 34, about which end panel folding element 32 is pivotable, and an axis substantially parallel or corresponding to the axis 38, about which corner panel folding element 36 is pivotable. As will become apparent from the following description, axis 69 may be an actual axis provided by a respective hinge, or a virtual axis about which guiding plate 68 moves during use while being mounted in ball joint or other type of hinge allowing movements about different axes and while being actuated by one or more actuators.

In the shown embodiment, folding unit 66 comprises a blank fixing element 70 for fixing in particular a bottom or top panel of a cardboard blank, to which panel an end panel to be folded by end panel folding element 32 and a side panel to be folded by side panel folding element 36 are attached. Fixing element 70 may be in implemented in form of an elastic suction cup, which is connected with means for evacuating air from the suction cup so that the surrounding air pressure would press a corresponding panel placed on fixing element 70 to the fixing element. Depending on the specific implementation of the folding unit, such fixing element may not be necessary, for example when the folding unit is used to fold panels upward after items to be packaged have been placed on a bottom panel of a cardboard blank. Depending on the form and weight of the items, the items may fix the blank sufficiently while the side and end panels and also the corner panels attached to the end panels are being folded.

In the shown embodiment, guiding plate 68 has substantially the shape of a quarter circle with rounded corners. In use, its upper edge 72, which forms a straight edge, will in the end position of the movement of guiding plate 68 (said position also being denoted as "final working position") be positioned substantially along an end portion of a crease line between a bottom panel and a respective side panel. During movement of an end panel, the flat surface of the guiding plate 68 will guide the respective corner panel attached to said end panel.

When the guiding plate 68 starts its movement from the idle position, which is shown in FIG. 4, it will first come into contact with a respective corner panel via rounded tip 74. The movement and functioning of the corner panel folding element 14 and the guiding plate 68 will now be described with reference to FIGS. 5 to 11.

Figure 5:
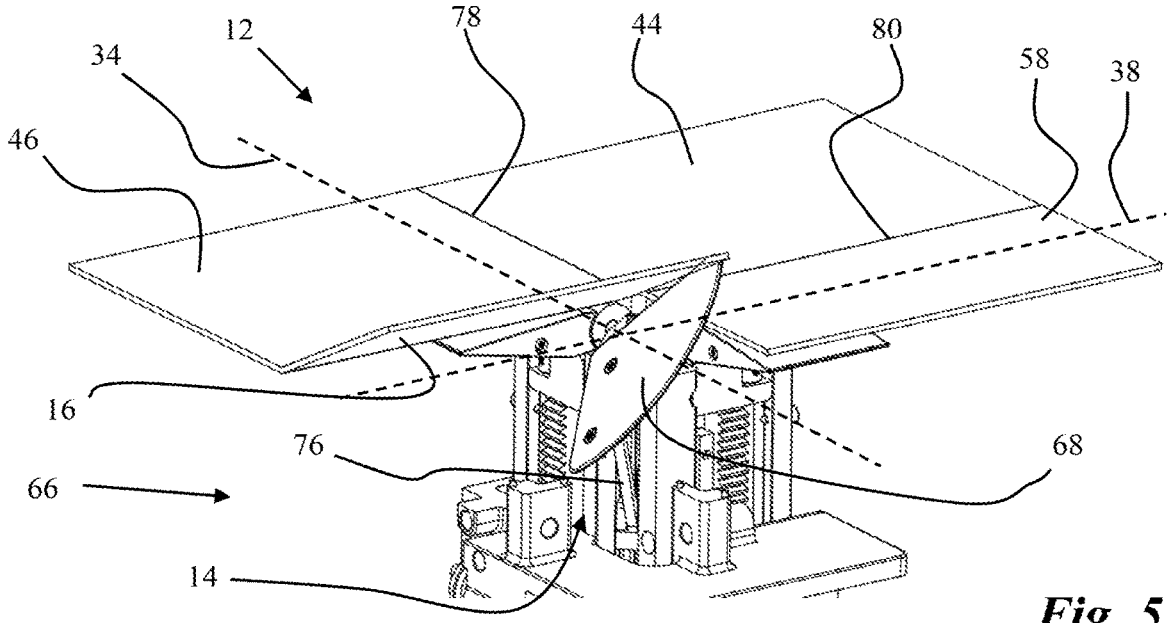
FIG. 5 shows the folding unit according to FIG. 4 in a situation, where a cardboard blank (of which only a part is shown) has been placed on the folding unit and a corner panel folding element has started folding the corner panel.

FIG. 5 shows the upper part of a folding unit 66 in a situation, in which a cardboard blank 12, of which only a small part is shown, has been placed on folding unit 66. Of blank 12, bottom panel 44, end panel 46 and side panel 58 are shown only partially, while corner panel 16 is shown completely. Bottom panel 44 may be fixed as relative position to folding unit 66 by activating the fixing means described above.

In the situation shown in FIG. 5, corner panel folding element 14 has already been activated and guiding plate 68 has started its movement coming into contact with corner panel 16 via its rounded tip (denoted by 74 in FIG. 4). The movement of guiding plate 68, which as mentioned above can be described as a pivoting movement about two axes 34 and 38, is caused in part by a first actuator 76 and by a respective hinge on the guiding plate 68. Each of said axes 34 and 38 runs substantially parallel to a respective one of two crease lines 78 and 80, along which end panel 46 respectively side panel 58 are to be folded. A third crease line, which can be regarded as an extension of crease line 80, is formed between end panel 46 and corner panel 16 in order to facilitate folding of corner panel 16.

Figure 6:
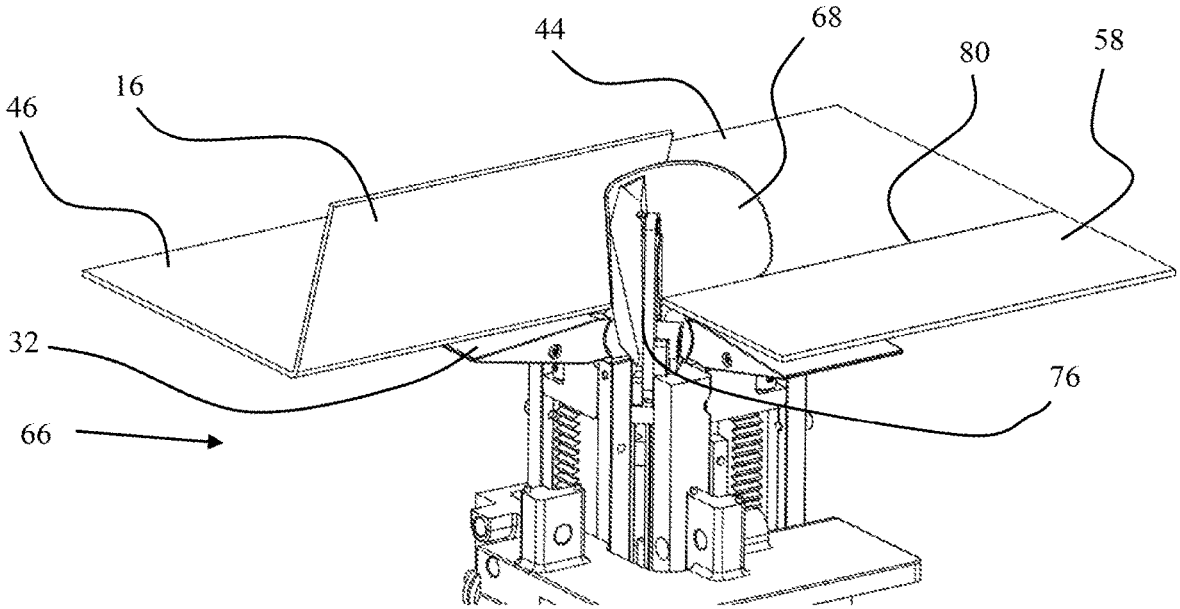
FIG. 6 shows the folding unit according to FIG. 5 in a situation, where a guiding plate of the corner panel folding element has pivoted about both of its axes in order to guide the corner panel upwards.

FIG. 6 depicts folding unit 66 according to FIG. 5 in a situation, where guiding plate 68 has completed its pivoting motion about the two axes so that its straight edge mentioned above and denoted with 72 in FIG. 4 has come into contact with blank 12 such that it runs substantially parallel to and on or close to the crease line 80 that forms the boundary between bottom panel 44 and side panel 58. This also ensures that the bottom panel is kept down when folding of the side panel 58 starts.

The straight edge 72 may be provided such that in the final working position of the movement of the guiding plate it ensures that the edge of the corner panel 16 does not hinder the folding of side panel 58. The flat surface of the guiding plate 68 may be provided such that, in the final working position it forms a plane running an angle of about 45° to 90°, preferably of about 60° to 80° with respect to the plane of the bottom panel 44 positioned on the folding unit. This ensures that the corner panel will not collide with any articles positioned on the bottom panel.

In the situation shown in FIG. 6, guiding plate 68 is still in contact with corner panel 16, which will slide along the guiding plate 68 when end panel 46 will be pushed upwards by end panel folding element 32. It should be noted that while the described movement of the guiding plate about axis 38 and about axis 34 can ensure smooth contact between guiding plate 68 and corner panel 16, it may in certain cases be fully sufficient for proper folding of a corner panel 16 to use a guiding plate that is moveable only about one axis.

Figure 7:
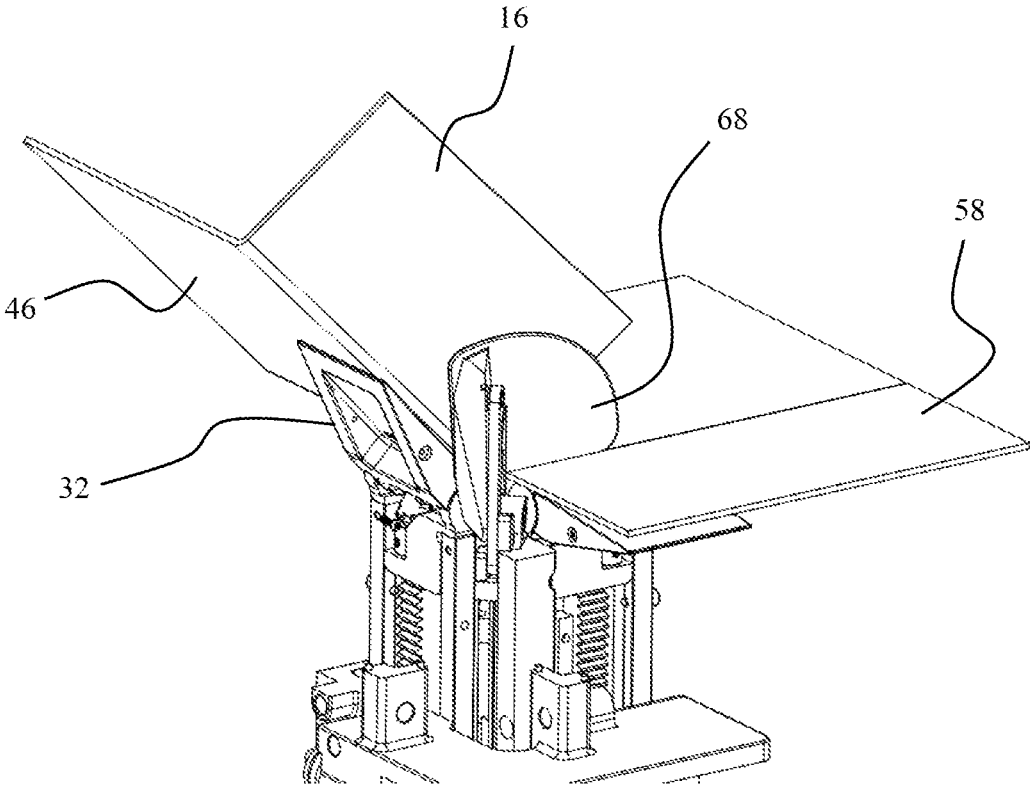
FIG. 7 shows the folding unit according to FIG. 6 in a situation, where an end panel folding element has started pushing an end panel and the corner panel attached to it upwards while the corner panel is guided by the guiding plate of the corner panel folding element.

FIG. 7 depicts the situation, where end panel folding element 32 has started pushing end panel 46 and hence also corner panel 16 attached to it upwards while corner panel 16 is guided by guiding plate 68, along which it slides.

Figure 8:
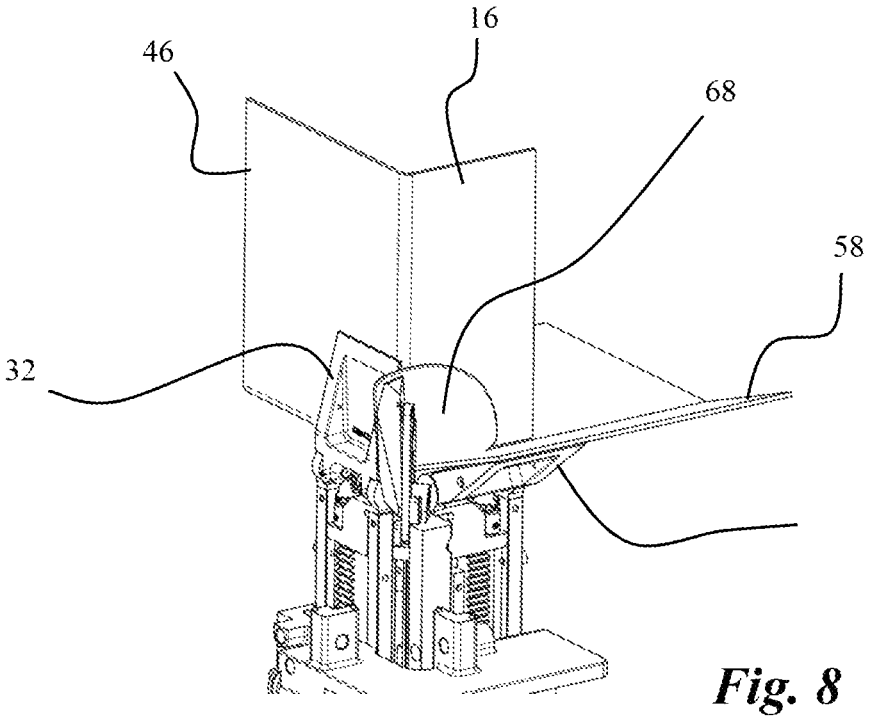
FIG. 8 shows the folding unit according to FIG. 7 in a situation, where the end panel folding element has pushed the end panel and the corner panel attached to it into their fully erected positions, while a side panel folding element has started pushing a side panel upwards.
Figure 9:
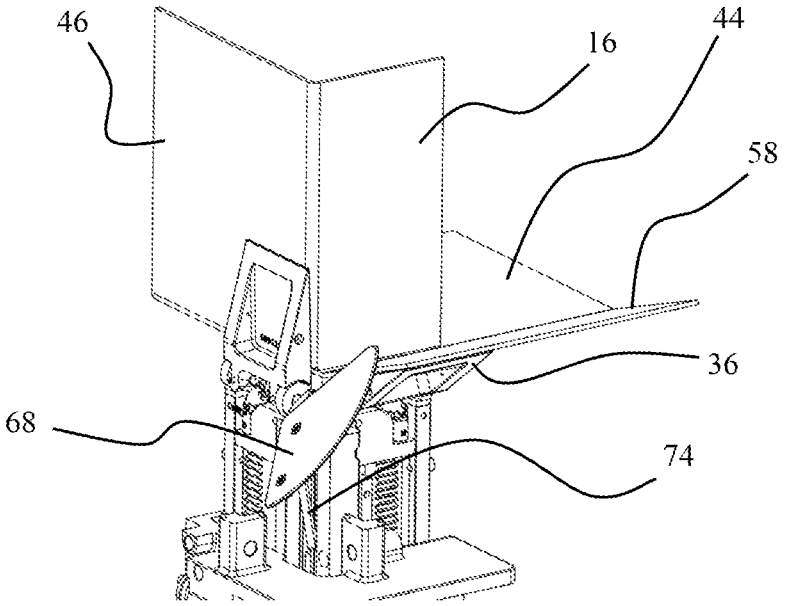
FIG. 9 shows the folding unit according to FIG. 8 in a situation, where the side panel has been folded far enough to prevent the corner panel from folding outward again and the guiding plate has started moving back to its idle position.

FIG. 8 depicts the situation, where end panel folding element 32 has pushed end panel 46, and hence also corner panel 16, into their fully erected positions, while side panel folding element 36 has started to push side panel 58 upwards. Corner panel 16 is perfectly held in its intended final position by guiding plate 68. In particular, guiding plate 68 prevents that corner panel 16 could "open", i.e. flip outwardly from the inner box being about to be created (namely as shown in FIG. 3 by folding the end panels 46 and 48 and the side panels 58 and 60 upward), which would obstruct the folding of side panel 58 and could kink corner panel 16. Once corner panel 58 has been bend sufficiently upwards, guiding plate 68 can start to retract as the mentioned "opening" of corner panel 16 will then be prevented by side panel 58. FIG. 9 depicts this situation.

In FIG. 9, actuator 76 has started retracting guiding plate 68 from its final position, which is shown in FIGS. 6-8, to its idle position, which is shown in FIG. 4. In the shown embodiment, the guiding plate 68 will upon retraction simply follow the same path it took while being moved from its idle position to its final position. Once guiding plate 68 has left the space between corner panel 16 and side panel 58, side panel folding element 36 will push the side panel 58 in its final position, which is substantially perpendicular to bottom panel 44.

Figure 10:
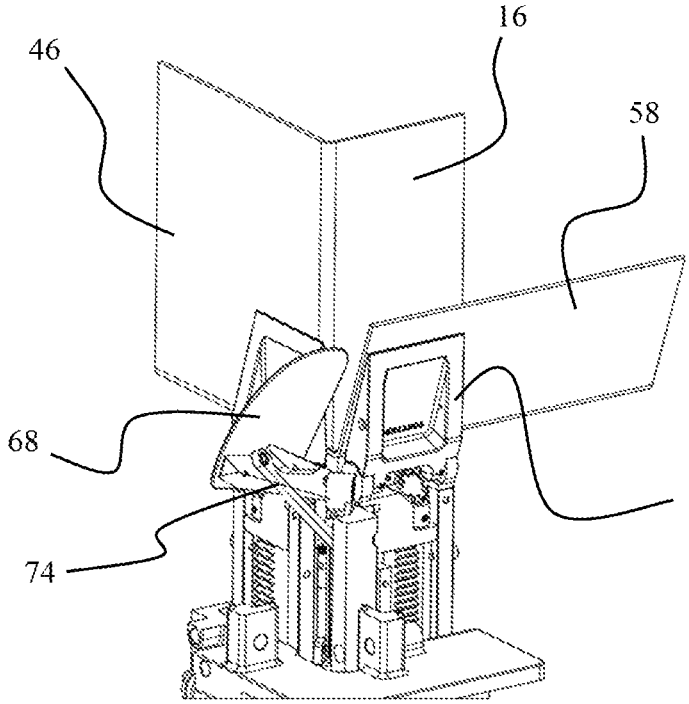
FIG. 10 shows the upper part of a folding unit according to a second embodiment of the invention in a situation very similar to that shown in FIG. 9, in which however the guiding plate follows upon retraction to its idle position a different path of movement than that of FIG. 9.

FIG. 10 shows a different embodiment of a folding unit according to the invention in a situation, in which the guiding plate 68 has started its movement back to the idle position. However, in this embodiment the path, along which the guiding plate 68 is moved from its idle position into its final working position shown in FIG. 8 differs from the path, along which it is retracted from its final working position into its idle position.

When the guiding plate 68 is moved into the final working position, it has to make smooth contact with the corner panel in order to ensure proper guiding. During the movement from the idle position to the final working position, side panel 58 does not hinder the movement of corner panel 16 and guiding plate 68. However, once the guiding function of guiding plate 68 is "handed over" to the side panel 58 when the side panel 58 has been pushed upward for an sufficient amount, which—as described above—will prevent that corner panel 16 could "open up", side panel 58 limits the space for free movement of the guiding plate 68.

While sufficient contact between corner panel 16 and side panel 58 can be ensured when the corner panel has been folded up as shown in FIG. 9, so that the guiding plate 68 could follow upon retraction to the idle position the same path it took when being brought into the final working position, depending on the type of cardboard used it can be advantageous to be able to fold side panel 58 further towards corner panel 16 before guiding plate 68 is retracted from the space between corner panel 16 and side panel 58.

If side panel 58 is folded further upward, guiding plate 68 may no longer take the same path upon retracting to the idle position it took when being brought from the idle position into the final working position. In the embodiment shown in FIG. 10, actuator 76 is therefore moved in a direction towards the side of end panel 46 when retracting the guiding plate 68, so that guiding plate 68 first makes a movement substantially along the axis, which is at least substantially parallel to the folding line between the bottom panel and end panel 46, i.e. guiding plate 68 moves upon retraction first substantially parallel to the corner panel 16.

Figure 11:
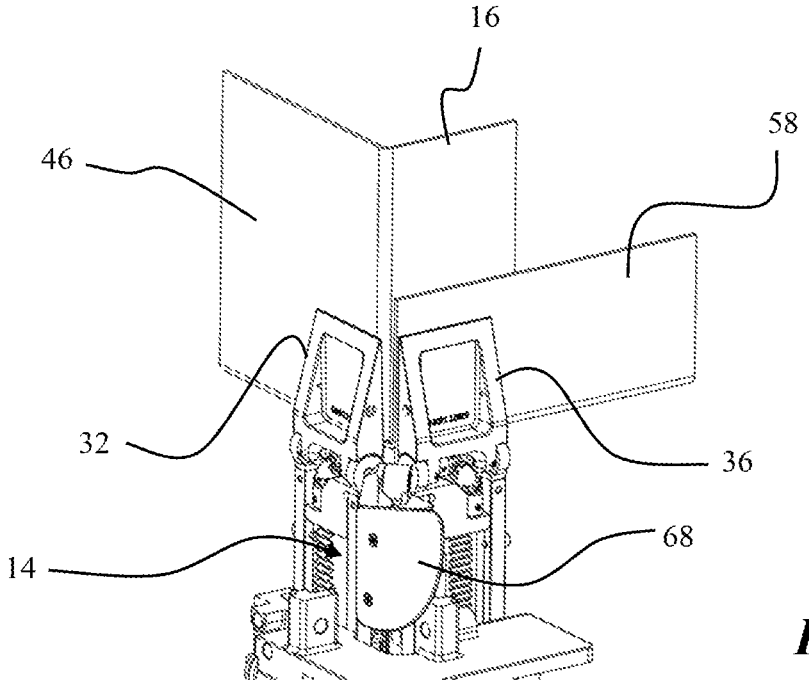
FIG. 11 shows the folding unit according to FIG. 9 in a situation, in which the end and side panel folding elements have pushed the side, end and corner panels to their fully erected positions while the corner folding element has been retracted to its idle position.

Once guiding plate 68 has left the space between corner panel 16 and side panel 58, it can also move about the axis which is at least substantially parallel to the folding line between the bottom panel and side panel 58 in order to finally reach its idle position. During this movement of guiding plate 68, side panel folding element 36 may push side panel 58 further upward into its finally fully erected position, which is depicted in FIG. 11. Such movement of guiding plate 68 along different paths can be achieved in different ways, for example by mounting it on a ball joint and providing two actuators, one for rotation substantially about axis 34 and one for rotation substantially about axis 38. Two actuators allow adapting the movement paths to different blank dimensions.

FIG. 11 shows the situation of both embodiments, the one shown in FIGS. 4 to 9 and the one shown in FIG. 10, when end panel folding element 32 and the side panel folding element 36 have reached their final positions and end panel 46, corner panel 16 and side panel 58 are fully erected, while corner panel folding element 14 and in particular guiding plate 68 have been retracted into the idle position. Once the side panel has been folded sufficiently to ensure proper maintaining of the corner panel, the operations of retracting the guiding plate to its idle position and folding the side panel further upwards may be executed serially or in parallel.

Figure 12:
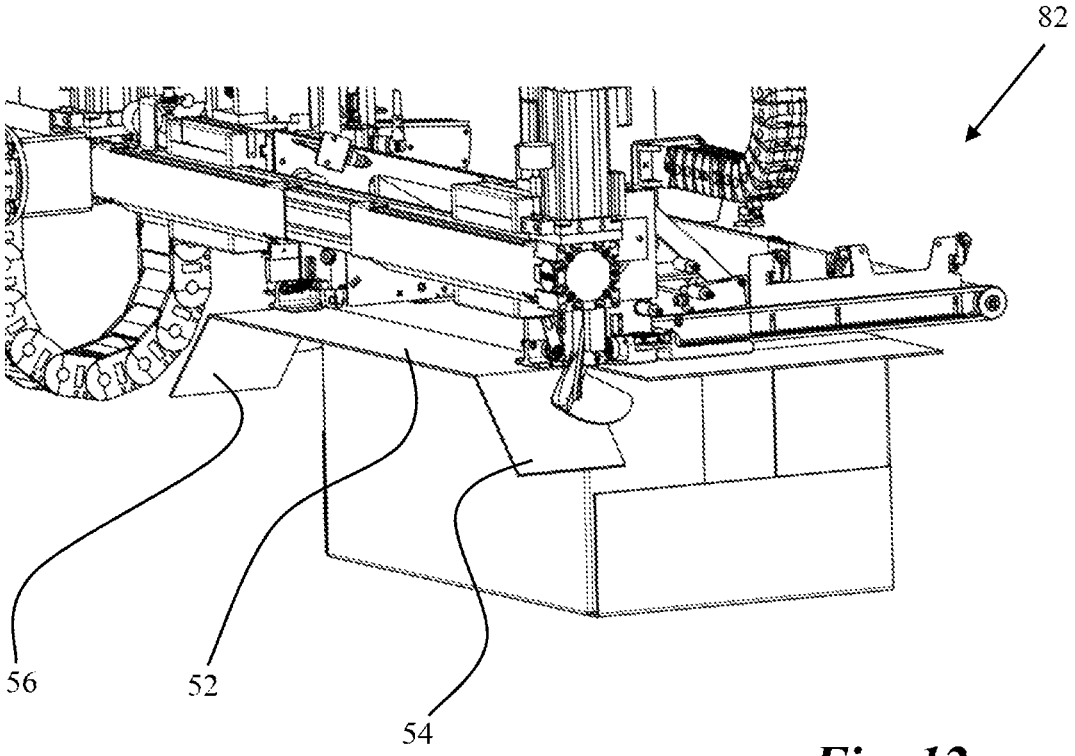
FIG. 12 shows schematically a part of a folding apparatus in a situation, where two folding units according to at least one illustrated embodiment of the invention are folding an end panel, two corner and two side panels of an upper panel in order to form the upper part of a packaging box.

While the foregoing description has been given with respect to folding side and end panels attached to a bottom panel of a cardboard blank, so that the respective panels were pushed upwards, it is obvious for an expert in the art that folding units according to the various described embodiments may be used in any orientation. In particular, the folding units may also be used to fold the side, end and corner panels of a top panel of a cardboard blank for packaging boxes in order to close the box. This is shown in FIG. 12, which depicts a folding apparatus 82 for the upper panels of a cardboard box, said apparatus comprising two folding units according to at least one implementation to fold end panel 52 and corner panels 54 and 56. In this case, the respective side panel folding elements, corner panel folding elements and end panel folding elements push the respective panels of the cardboard blank downwards. The guiding plates will also guide the corner panels to their desired end position when the end panel is folded. Furthermore the straight edge 72 of the guiding plate will support the top panel when the side panel is folded.

Within the scope of the invention, which is solely defined by the appended claims, numerous variations of the embodiments described above can be made. For example, the guiding plate does not necessarily have to have the shape of a quarter circle, and its movement from the idle position to the final working position can be caused by different means, such as electro-mechanic, pneumatic or hydraulic actuators. While embodiments have been described in which the movement of the guiding plate can be considered as a combined movement about two axes, one of said two axes being substantially parallel to the crease line along which the end panel shall be folded, and the other one of said two axes being substantially parallel to the crease line along which the side panel shall be folded, it can be fully sufficient to provide the corner panel folding element with a guiding plate moveable only about one axis, for example an axis running at about 45° degrees with respect to the crease lines between an end panel and a side panel, or even almost parallel to the crease line along which the end panel shall be folded. In such case, the rounded tip of the guiding disk will push the corner panel upwards, when the guiding disk is turned about the axis, and the corner panel will slide along the tip and the edge mentioned above until it comes into contact will the flat surface of the guiding disk.

As described above, the folding units can be mounted to be moveable to different positions, and accordingly an apparatus for folding cardboard blanks into boxes may comprise e.g. four or six folding units for folding a respective one of each corner panels of a cardboard blank as described above, or may comprise less folding units than a respective blank has corner panels, in case of which the folding units could be moved to different positions in order to fold the corner panels.

The end panel folding element may comprise a panel fixing element, in particular a suction cup, for fixing an end panel of a cardboard blank.

In using an apparatus having two folding units at opposite corner panels of one end panel, the end panel will be aligned with respect to the apparatus when the folding units start their pivoting movement. In retracting the guiding plate along a path that differs from the path it took when being moved from the idle to the final working position, the guiding plate may also be moved transversally out of the region between the corner panel and the respective side panel.

The teachings of German patent application DE 10 2015 123 012, filed Dec. 31, 2015, are incorporated herein in its entirety.

LIST OF REFERENCE NUMBERS

10 folding apparatus
12 cardboard blank
14 corner panel folding element
16 corner panel
18 corner panel
20 corner panel
22 corner panel
24 rod
26 rod
28 rod
30 folding unit (prior art)
32 end panel folding element
34 axis
36 side panel folding element
38 axis
40 initiator
42 direction of movement of initiator
44 bottom panel
46 end panel
48 end panel
50 top panel
52 end panel
54 corner panel
56 corner panel
58 side panel
60 side panel
62 side panel
64 side panel
66 folding unit
68 guiding plate
69 axis
70 fixing element
72 edge of guiding plate

74 rounded tip of guiding plate
76 actuator
78 crease line
80 crease line
82 folding apparatus

The invention claimed is:

1. A folding unit to fold cardboard blanks having an end panel, a corner panel, a bottom panel, and a side panel, said folding unit comprising:

an end panel folding element actuable to pivot about a first axis of a first hinge;

a side panel folding element actuable to pivot about a second axis of a second hinge; and a corner panel folding element, said corner panel folding element comprising a guiding plate, said guiding plate actuable to move independently of the end panel folding element, while the end panel folding element remains stationary, the guiding plate pivots about two different axes to place a straight edge of said guiding plate substantially parallel to said second axis such that said straight edge runs on or close to a crease line between the side panel and the bottom panel and blocks the bottom panel from lifting up while the side panel is folded up, and to initiate folding the corner panel about an axis that is substantially parallel to said second axis, wherein one of the at least two different axes is an axis of a third hinge running at an angle of about 0° to 60° with respect to said first axis.

2. The folding unit according to claim 1 wherein said one of the at least two axes is an actual axis of said third hinge, which runs at an angle of about 40° to 50° with respect to said first axis.

3. The folding unit according to claim 1 wherein said one of the at least two axes is a virtual axis of movement of said guiding plate provided by one or more hinges.

4. The folding unit according to claim 1 wherein said guiding plate is actuable to move about one further axis, said further axis substantially parallel to said first axis or to said second axis.

5. The folding unit according to claim 4 wherein said guiding plate is actuable to move about two axes, one of the two axes at least substantially parallel to said first axis and another one of the two axes at least substantially parallel to said second axis.

6. The folding unit according to claim 1 wherein said guiding plate substantially has the form of a quarter disk having a rounded tip shaped to make smooth contact with a corner panel to be folded.

7. The folding unit according to claim 1 wherein said guiding plate comprises a flat surface, which in an end position of the movement of the guiding plate about said at least two different axes will form a plane forming an angle of about 45° to 90° with the plane of a bottom panel or top panel positioned on respectively at the folding unit.

8. The folding unit according to claim 1 wherein said guiding plate comprises a flat surface, which in an end position of the movement of the guiding plate about said at least two different axes will form a plane forming an angle of about 60° to 80° with the plane of a bottom panel or top panel positioned on respectively at the folding unit.

9. The folding unit according to claim 1, further comprising at least one electro-mechanic, pneumatic or hydraulic actuator coupled to move said guiding plate about said at least two different axes.

10. The folding unit according to claim 1 wherein said end panel folding element comprises a panel fixing element, in particular a suction cup, for fixing an end panel of a cardboard blank.

11. The folding unit according to claim 1, further comprising:

a first actuator communicatively coupled to said end panel folding element to pivot said end panel folding element about said first axis;

a second actuator communicatively coupled to said side panel folding element to pivot said side panel folding element about said second axis; and a third actuator communicatively coupled to said corner panel folding element to move said guiding plate about at least one of said at least two different axes.

12. The folding unit according to claim 11 wherein the one of the two different axes is substantially perpendicular to the other of the two different axes.

13. The folding unit according to claim 1 wherein said guiding plate has substantially a shape of a quarter circle with rounded corners and an upper edge formed by said straight edge of said guiding plate.

14. The folding unit according to claim 1 wherein the first axis, the second axis, and the one of the at least two different axes are all fixed with respect to a common plane.

15. A folding unit to fold cardboard blanks having an end panel, a corner panel and a side panel, said folding unit comprising:

an end panel folding element actuable to pivot about a first axis of a first hinge;

a side panel folding element actuable to pivot about a second axis of a second hinge; and a corner panel folding element, said corner panel folding element comprising a guiding plate comprising a straight edge, said guiding plate actuable to move prior to and independently of the end panel folding element, while the end panel folding element remains stationary, the guiding plate pivots about a third axis in order to initiate folding the corner panel about an axis that is substantially parallel to said second axis, wherein said third axis is an axis of a third hinge running at an angle of about 0° to 60° with respect to said first axis, and said guiding plate is further actuable to rotate about a fourth axis, said fourth axis substantially perpendicular to said third axis, wherein rotation of the corner panel folding element about the third axis moves the fourth axis relative to the end panel folding element.

16. The folding unit according to claim 15, further comprising:

a first actuator communicatively coupled to said end panel folding element to pivot said end panel folding element about said first axis;

a second actuator communicatively coupled to said side panel folding element to pivot said side panel folding element about said second axis; and a third actuator communicatively coupled to said corner panel folding element to move said guiding plate about said at least one axis.

17. The folding unit according to claim 15 wherein said guiding plate has substantially a shape of a quarter circle with rounded corners and an upper edge formed by said straight edge of the guiding plate.

18. A folding unit to fold cardboard blanks having an end panel, a corner panel, a bottom panel, and a side panel, said folding unit comprising:

an end panel folding element actuable to pivot about a first axis of a first hinge;

a side panel folding element actuable to pivot about a second axis of a second hinge; and a corner panel folding element, said corner panel folding element comprising a guiding plate, said guiding plate actuable to move independently of the end panel folding element, while the end panel folding element remains stationary, the guiding plate pivots about a third axis to place a straight edge of said guiding plate substantially parallel to said second axis such that said straight edge runs on or close to a crease line between the side panel and the bottom panel and blocks the bottom panel from lifting up while the side panel is folded up, and to initiate folding the corner panel about an axis that is substantially parallel to said second axis, and the guiding plate including a curved edge that, when the guiding plate is positioned with said straight edge on or close to the crease line between the side panel and the bottom panel, extends away from the straight edge, away from the second axis, and towards the first axis so as to be positioned to provide a sliding surface for the corner panel to move along when the end panel folding element folds the end panel upwards, wherein said third axis is an axis of a third hinge running at an angle of about 0° to 60° with respect to said first axis.

19. The folding unit according to claim 18 wherein said guiding plate substantially has the form of a quarter disk.

20. The folding unit according to claim 18, further comprising:

a first actuator communicatively coupled to said end panel folding element to pivot said end panel folding element about said first axis;

a second actuator communicatively coupled to said side panel folding element to pivot said side panel folding element about said second axis; and a third actuator communicatively coupled to said corner panel folding element to move said guiding plate about the third axis.

* * * * *